United States Patent [19]

Tombu

[11] 3,961,661

[45] June 8, 1976

[54] HANGING AND STRETCHING DEVICE FOR WALL COVERING FABRICS

[76] Inventor: Gerard J. Tombu, 8, Rue des Bouchers, F-02 Saint-Quentin, France

[22] Filed: Aug. 13, 1974

[21] Appl. No.: 497,077

[30] Foreign Application Priority Data

Aug. 2, 1974 France.....74.26919

[52] U.S. Cl...... 160/328; 160/392; 160/395

[51] Int. Cl.[2]..... A47H 23/00

[58] Field of Search ..... 160/327, 328, 354, 392, 160/395, 383, 394; 52/222, 273

[56] References Cited

UNITED STATES PATENTS

| | | | |
|---|---|---|---|
| 2,526,912 | 10/1950 | Swanson | 160/392 |
| 3,729,045 | 4/1973 | MacDonald | 160/395 |
| 3,783,931 | 1/1974 | Assael | 160/327 |
| 3,833,046 | 9/1974 | Tombu | 160/327 |
| 3,848,380 | 11/1974 | Assael | 160/395 |

*Primary Examiner*—Philip C. Kannan
*Attorney, Agent, or Firm*—Bacon & Thomas

[57] ABSTRACT

The invention pertains to a device for hanging and stretching wall covering fabrics, characterized by the fact that it consists of a combination of sections fixed along the two lateral edges of the wall to be covered and constituted by a sole-piece one side of which is plane and the other side of which has three profiled ribs delimiting the fastening elements, and of further sections fixed along the two lateral edges of the fabric and constituted by a lath the two lengthwise edges of which have slots by which the said sections attached to the fabric are fixed by fastening to the said sections attached to the wall.

6 Claims, 5 Drawing Figures

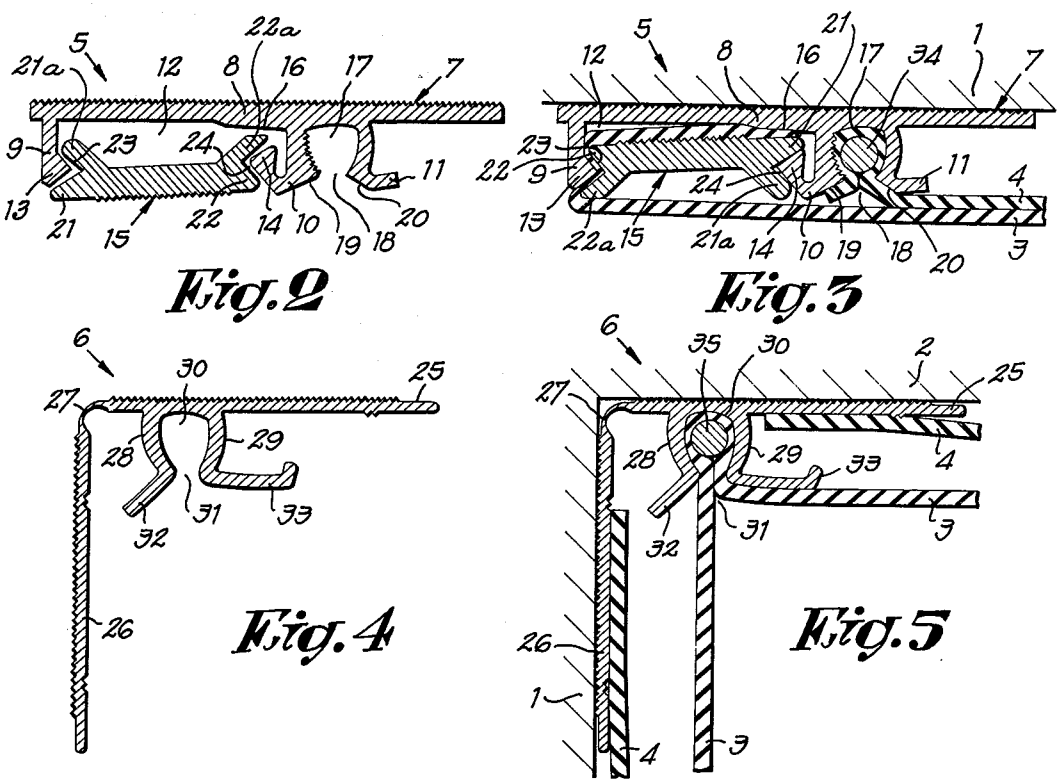
Fig. 3
Fig. 5
Fig. 2
Fig. 4
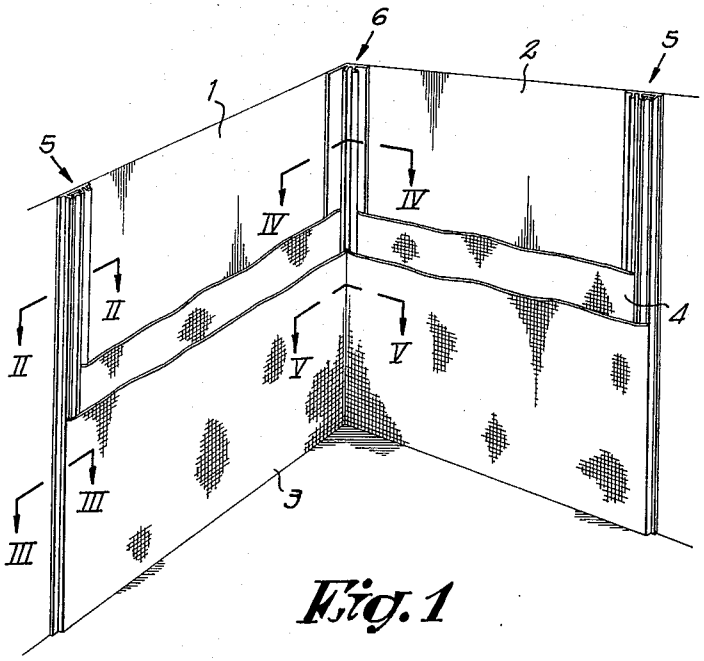
Fig. 1

HANGING AND STRETCHING DEVICE FOR WALL COVERING FABRICS

This invention concerns the technique of hanging and stretching wall fabrics. In this technique, means are employed for acting upon the fabric vertically and horizontally.

This invention essentially concerns the horizontal stretching of the fabric.

This stress is set up by hanging the fabric, using shaped sections, one of which is attached to the lateral edges of the wall or partition to be coverd and the other to the lateral edges of the fabric. The sections attached to the wall to be covered are called herein "fixed sections" and the sections attached to the fabric are called herein "mobile sections".

The fabric is stretched by turning a mobile section in relation to the fixed section attached to the wall.

Within the scope of this technique, not only the covering of a simple, plane partition has to be considered, but also the covering of adjacent partitions oriented in different planes.

The device which is the subject of the invention can be applied with the same efficacity in either case, using special fixed and mobile sections which are simple, light, quick and effortless to place, and ensure great hooking security.

In order to cover a simple partition with stretched wall fabric in accordance with the invention, use is made of sections which are fixed beforehand on the wall or partition to be covered and of sections which are to be fixed to the fabric. The sections attached to the wall or partition to be covered, i.e. the fixed sections, consist substantially of a strip or sole-piece the back of which is plane and the front of which has three ribs delimiting between them and adjoining, on the one hand a means of hooking for a section attached to the fabric, i.e. a mobile section, and on the other hand a housing for hooking the fabric using a relatively flexible ring.

Starting with a dihedron-shaped surface to be covered, i.e. a surface consisting of two adjacent partitions disposed in different planes, two such fixed and mobile section devices can be employed, arranged along the two lateral edges of each of the said partitions to be covered. Use may be made of a special fixed section forming a variant of the fixed section mentioned above. This special fixed section takes the form of two orthogonal sole-pieces attached together, one of the said sole-pieces having, on its inside, a narrow-entry hollow rib, the two rims of which have divergent borders.

Utilizing such a special section, one could, to cover two partitions forming a dihedron, employ, in combination, two sets of single sole-piece sections and, between them, a double sole-piece section.

One implementation of the device according to the invention is described below, reference being made to the appended drawings in which:

FIG. 1 summarily represents a view in perspective of two adjacent partitions on which the device according to the invention is applied;

FIG. 2 represents, on an enlarged scale, a cross-section along line II—II of FIG. 1;

FIG. 3 represents, on an enlarged scale, a cross-section along line III—III of FIG. 1;

FIG. 4 represents, on an enlarged scale, a cross-section along line IV—IV of FIG. 1; and FIG. 5 represents, on an enlarged scale, a cross-section along line V—V of FIG. 1.

The implementation schematized in FIG. 1 concerns two adjacent partitions 1–2 on which are stretched, for instance, a decorative fabric 3 and a fabric or lining 4 cooperating to give better sound and heat insulation. In this implementation, two sets of sections 5 conforming with FIG. 2 and one section 6 conforming with FIG. 4 are employed.

In the implementation represented in FIG. 2, a fixed section 7, i.e. a section intended to be fixed beforehand along the lateral edges of a wall or partition, is formed by a strip or sole-piece 8 the back of which is plane and preferably scored. On its front, the said sole-piece has three profiled ribs 9–10–11. Ribs 9 and 10 delimit a housing 12 the entry to which is narrowed by additional thicknesses 13–14, triangular in shape, forming fastening elements for a mobile section 15. Over a certain width and adjacent to rib 10, the bottom of the said housing 12 has one sloping side 16. Ribs 10–11 delimit between them a hollow 17 the narrowed entry to which has divergent edges 19–20.

Mobile section 15 consists of a simple lath bordered by lengthwise ribs **21–21*a* and 22–22*a* delimiting the lengthwise slots, respectively 23–24, triangular in section, intended to cooperate with the above-mentioned additional thicknesses 13–14** of the fixed sections.

The planar side of section 15 between the said marginal ribs 21–22 is preferably scored, as is one of the lateral partitions delimiting the said hollow 17.

The corner section 6, as shown in FIGS. 4 and 5, is so made that it has two strips or sole-pieces 25–26 the back of which is preferably scored, these two sole-pieces being all of one piece, their joint edge 27 being thinner so that these two sole-pieces can be attached to the adjacent sections whatever the angular displacement of the latter. The inside of sole-piece 25 has two profiled ribs 28–29 delimiting a hollow 30 the entry 31 to which is narrowed and extended by two divergent borders 32–33.

In the implementation represented in the appended drawings, the decorative fabric 3 is attached to a section 15 which is hooked to fixed section 7. If it is desired to stretch the said fabric 3 more, it suffices to turn section 15 round. The second fabric 4 is fixed to the fixed section 7 by means of a rod 34 inserted at the same time as the adjacent part of this fabric 4 in the hollow 17 delimited by ribs 10–11. For fixing the fabrics in the corner formed by the two partitions 1–2, the inside fabric 4 will be fixed to the sole-pieces 25–26 by gluing, clamping or any other suitable method, whilst the decorative fabric 3 will be attached to the said fixed section 6 by means of a ring 35 inserted in hollow 30 at the same time as the corrresponding part of the said fabric 3.

The adoption of such a special section 6 replaces, in a way, the use of two sets of sections 5 at the place of the junction between the two partitions 1–2 disposed in different planes.

Various modifications can of course be made by a skilled person to the devices or processes which have just been described solely as non-limitative examples, without going outside the scope of the invention.

What I claim is:

1. Device for hanging and stretching wall covering fabrics, of the type comprising a combination of first sections fixed along the two lateral edges of a wall to be covered and each constituted by a sole-piece one side of which is substantially plane and the other side of which has three profiled ribs forming fastening elements, two of which delimit a first housing and one of these fastening elements and a third one of the fastening elements delimiting a second housing; second sections fixed along the two lateral edges of a first fabric and each constituted by a lath the two lengthwise edges of which are provided with a slot, the slots of each of said second sections co-operating with the respective fastening elements delimiting the first housing of a said first section in such a manner that this second section is secured in this first section, said first fabric being clamped at each lateral edge thereof between a fastening element of the first section and a lengthwise edge of the respective second section; and rods each inserted with the adjacent part of a second fabric in a said second housing.

2. Device according to claim 1 characterized by the fact that the lateral edges of the first fabric is wrapped at least partially around the respective second section and each second section is insertable and secured in its respective first housing in either of two positions which are disposed 180° apart whereby said first fabric may be tensioned.

3. Device according to claim 1, characterized by the fact that the bottom of each said first housing has a sloping portion adjacent said one fastening element delimiting with the respective second section a wedge shaped space in which said first fabric is also clamped.

4. Device according to claim 3 characterized by the fact that the lateral edges of the first fabric is wrapped at least partially around the respective second section and each second section is insertable and secured in its respective first housing in either of two positions which are disposed 18° apart whereby said first fabric may be tensioned.

5. Device according to claim 1, characterized by the fact that the slots of each of said second sections are of triangular section and arranged so as to cooperate with triangular-shaped section edges disposed in opposed relation on the respective fastening elements delimiting said first housing.

6. Device according to claim 5, characterized by the fact that the back surface of each of the second sections is scored.

* * * * *